United States Patent [19]

Fujikawa et al.

[11] Patent Number: 4,697,555

[45] Date of Patent: Oct. 6, 1987

[54] VALVE GEAR FOR FOUR-CYCLE ENGINE

[75] Inventors: Tetsuzo Fujikawa, Kobe; Makizo Hirata, Kakogawa; Shinichi Tamba, Kakogawa; Noboru Fukui, Kakogawa, all of Japan

[73] Assignee: Kawasaki Jukogyo Kabushiki Kaisha, Japan

[21] Appl. No.: 848,209

[22] Filed: Apr. 4, 1986

[30] Foreign Application Priority Data

| | | | |
|---|---|---|---|
| Apr. 5, 1985 | [JP] | Japan | 60-72947 |
| Apr. 5, 1985 | [JP] | Japan | 60-72948 |
| Apr. 8, 1985 | [JP] | Japan | 60-75169 |
| Feb. 17, 1986 | [JP] | Japan | 61-32539 |

[51] Int. Cl.[4] ..... F01L 1/26

[52] U.S. Cl. ..... 123/90.23; 123/90.2; 123/90.17

[58] Field of Search ..... 123/90.2, 90.22, 90.23, 123/90.15, 90.16, 90.17

[56] References Cited

U.S. PATENT DOCUMENTS

| | | | |
|---|---|---|---|
| 979,794 | 12/1910 | Peteler | 123/90.23 |
| 1,102,717 | 7/1914 | Brown | 123/90.2 |
| 1,248,597 | 12/1917 | Baker | 123/90.2 |
| 1,708,749 | 4/1929 | Adam | 123/90.2 |
| 1,741,090 | 12/1929 | Adam | 123/90.2 |
| 1,817,153 | 8/1931 | Kinder | 123/90.2 |
| 2,843,095 | 7/1958 | Prentice | 123/90.2 |
| 2,907,311 | 10/1959 | Waldron | 123/90.15 |
| 3,262,435 | 7/1966 | Cribbs | 123/90.15 |
| 4,577,592 | 3/1986 | Bosch et al. | 123/90.15 |

*Primary Examiner*—Ira S Lazarus

[57] ABSTRACT

A valve gear adapted for a four-cycle engine having a guide portion formed on the outer surface of an output shaft connected to a crankshaft, and of such a shape folding around the output shaft as to return back to a starting point in two turns, and having interlocking mechanisms provided with portions engaging with the guide portion and moved by the rotation of the crankshaft to open valves. The guide portion, only one in number, is provided on the output shaft connected to the crankshaft, and the interlocking mechanisms for driving intake and exhaust valves are disposed substantially opposite to each other across the output shaft as to engage with aforesaid single guide portion.

9 Claims, 15 Drawing Figures

VALVE GEAR FOR FOUR-CYCLE ENGINE

FIELD OF THE INVENTION AND RELATED ART STATEMENT

This invention relates to a valve gear for a small and general-purpose four-cycle engine.

Generally, the small and general-purpose four-cycle engine requires low cost, light weight and compactness.

To meet aforesaid requirements, the applicant of the invention has previously proposed, in the U.S. patent application Ser. No. 811,890, a valve gear wherein guide portions are formed at two locations on the output shaft connected to the crankshaft, and respectively provided with interlocking mechanisms to open the intake and exhaust valves, thus eliminating the cam shaft to make the engine small and compact.

But, in aforesaid gear, provision of the two guide portions for driving the intake and exhaust valves causes the output shaft to become long, thus making the outline of the engine large.

And, when the related art is adapted for a side valve type engine, so-called "L-type" arrangement in which the intake and exhaust valves are disposed in juxtaposition, is difficult to realize.

Another problem lies in the difficulty in machining the guide portions, because it is necessary to form the guide groove providing cam forces projecting radially at one point and also an intersection.

Still other problem lies in the large inertia mass of the interlocking mechanisms, because the guide portions are required to combine axial guidance of the interlocking mechanisms along the crankshaft with vertical movement of them.

OBJECT AND PURPOSE OF THE INVENTION

It can be said that the purpose and object of this invention is to provide a valve gear adapted for a four-cycle engine wherein the intake and exhaust valves are opened without a cam shaft, thus eliminating aforesaid problems and allowing for a compact outline of the engine.

To achieve aforesaid object according to the invention, in a valve gear adapted for the four-cycle engine having a guide portion formed on the outer circumference of an output shaft connected to a crankshaft to give such a shape folding the output shaft as to return back to a starting point in two turns, and having interlocking mechanisms providing the engaging portions engaging with the guide portion and being moved by the rotation of the crankshaft to open the valves, only one guide portion is disposed on the one output shaft, and two interlocking mechanisms respectively driving the intake and exhaust valves are disposed substantially opposite to each other across the output shaft so as to engage with aforesaid one guide portion.

As mentioned above, the outline of the engine is made compact by the operation of the two interlocking mechanisms with the one guide portion.

Furthermore, by forming aforesaid guide portion into such a shape that the guide position of aforesaid interlocking mechanisms axially reciprocates once in two turns of the crankshaft, maintaining the same radial distance from the rotation axis of the crankshaft, and by supporting aforesaid interlocking mechanisms rotatably about a journal intersecting at right angles to the output shaft and making one point on aforesaid guide portion a rocking member thereof, and by constructing the rocking member so as to be provided with means for lifting the valves by the rocking motion thereof, the higher portions projecting radially on the guide portion are eliminated, the guide length becomes relatively long, and the guide portion can have a smooth shape, which facilitates machining thereof.

BRIEF DESCRIPTION OF THE DRAWING

In the accompanying drawings, there are shown illustrative embodiments of the invention from which these and other of its objectives, novel features and advantages will be readily apparent.

In the drawings.

DETAILED DESCRIPTION OF THE PREFERRED EMBODIMENTS

Figure 1:
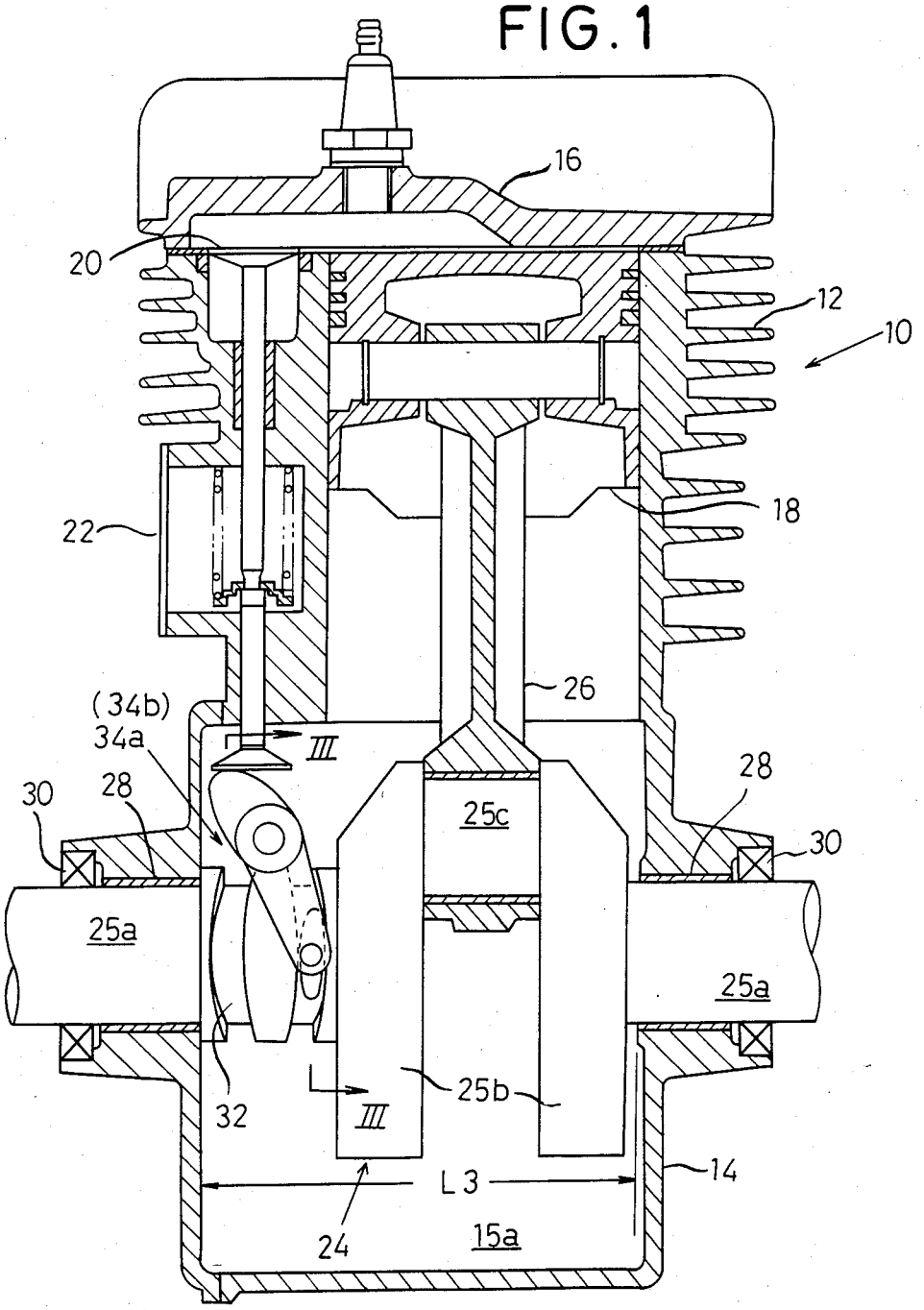
FIG. 1 is a vertical sectional view of a first embodiment adapted for a four-cycle engine according to the invention.

The following is the detailed description of the embodiments according to the invention, referring to the drawings.

In FIG. 1, Numeral 10 designates an engine block, wherein a cylinder 12 and a crankshaft etc. are integrally formed. The cylinder 12 is equipped with a cylinder head 16 at the upper end thereof. A piston 18 is slidably inserted in the bore of the cylinder 12.

An intake valve 20 is disposed at the side of aforesaid cylinder 12, and an exhaust valve (not shown in the figure) is similarly disposed adjacent to the intake valve 20 in the vertical direction of the figure. Numeral 22 is a removable side cover.

The crankcase 14 is formed as an oil pan 15*a* at the bottom, and a crankshaft 24 is rotatably contained therein. The crankshaft 24 is a forging integrally combining an output shaft 25*a*, a crank web 25*b* and a crank pin 25*c*. The crank pin 25*c* is connected with the piston 18 through a connecting rod 26. Both ends of the output shaft 25*b* are supported to the crank case 14 with metal bearings 28. Numeral 30 designates oil seals.

A guide groove 32 is formed on the left side of the output shaft 25*a* in the figure, and interlocking mechanisms 34*a* and 34*b* detailed later are engaging therewith.

Figure 3:
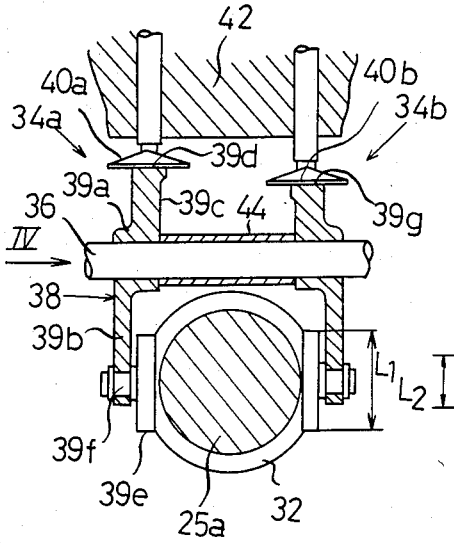
FIG. 3 is a partially sectional view taken along III—III in FIG. 1.
Figure 2:
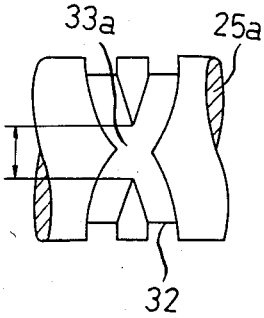
FIG. 2 is a front view of a guide groove.

The guide groove 32 has an essentially square-groove shaped section, and if axially developed, as shown in FIG. 2, forms such a "figure-eight", folding around the output shaft 25*a*, as to return back to a starting point in two turns, and having one intersection at the center of the "figure-eight". As shown in FIG. 3, the guide groove 32 is formed so that the radial distances from the axis of the output shaft 25*a* to the guide groove 32 are all the same at any point thereon.

Also, as shown in FIG. 3, the interlocking mechanisms 34*a* and 34*b* are disposed opposite to each other across the output shaft 25*b*, and the former is to drive the intake valve 20 and the latter the exhaust valve (not shown).

One of the interlocking mechanisms 34*a* consists of a journal 36, a rocking member 38 etc. The journal 36 is disposed at right angles to and over the output shaft 25*a*, and also secured with the crankcase 14.

The rocking member 38 rotatably supported by the journal 36 is a forging integrally combining a boss 39*a*, an arm 39*b* and a cam 39*c* (Refer to FIG. 1), the arm 39*b* extends downwards from the boss 39*a* adjacent to a side of the output shaft 25*a*. The cam 39*c* is formed radially outwards of the output shaft 25*a*, and a cam face 39*d* on the cam 39*c* depresses up against a flat tappet 40*a* to open the intake valve 20. The flat tappet 40*a* is disposed vertically and extends slidably through a supporting wall 42.

A follower 39*e* rotatably supported at the lower end of the arm 39*b* by a shaft 39*f*, fits into the guide groove 32, so that their engaging point reciprocates essentially in the axial direction of the output shaft 25*a* as the output shaft 25*a* rotates, thus rocking the rocking member 38 about the journal 36.

As shown in FIG. 1, the follower 39*e* has substantially a shape of spindle which is gradually tapered toward both ends thereof and whose length L1 is set longer than that L2 of an intersection 33*a* (FIG. 2) in the guide groove 32.

Therefore, there is no possibility of such malfunction as the follower 39*e* should track into a wrong path at the intersection 33*a*, not only when the crankshaft 24 rotates as usual in the normal direction, but also when the crankshaft 24 rotates in the reverse direction in the start etc.

On the other hand, the another interlocking mechanism 34*b* for driving the exhaust valve is also constructed similarly to the above, so a cam face 39*g* on the interlocking mechanism 34*b* depresses up against another flat tappet 40*b* for the exhaust valve, and is profiled to a phase corresponding to the opening timing of the exhaust valve. In FIG. 3, Numeral 44 designates a spacer.

The operation is described as follows. When the crankshaft 24 starts to rotate, for instance, the follower 39*e* in the interlocking mechanism 34*a* in use for the intake valve 20 is guided along the guide groove 32 and slides over the circumference of the guide groove 32 while the crankshaft 24 makes two turns, thus rocking back and forth once the whole rocking member 38 about the journal 36.

Figure 4:
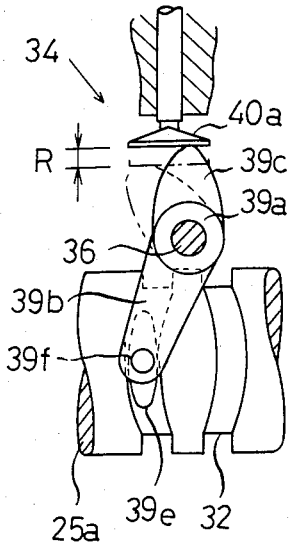
FIG. 4 is a fragmentary view taken in the direction of the arrow IV of FIG. 3.

Aforesaid rocking of the rocking member 38 causes the cam 39*c* to rock, as shown in FIG. 4, between the position shown by solid line and that by broken line. At this time, the flat tappet 40*a* depresses down against the cam face 39*d* on the cam 39*c* rises and falls within the range of lift R, thus lifting the intake valve 20 to open.

On the other hand, the other interlocking mechanism 34*b* in use for the exhaust valve is disposed opposite to the interlocking mechanism 34*a* across the output shaft 25*a*, and opens the exhaust valve at a phase essentially 180 degrees different from that of the intake valve 20, even though the other interlocking mechanism slides guided by the same guide groove 32. Furthermore, the cam face 39*g* on the other interlocking mechanism 34*b* is profiled to the phase corresponding to the opening timing of the exhaust valve, so the opening timing of the exhaust valve is properly controlled.

The metal bearings 28, the guide groove 32 and the follower 39*e* etc. are subjected to so-called splash lubrication.

Aforesaid interlocking mechanisms 34*a* and 34*b* are interlocked by the one guide groove 32 to open both the intake valve 24 and the exhaust valve, which results in elimination of the need for providing two guide portions for the intake valve 20 and the exhaust valve, thus shortening the axial length L3 of the crankshaft 24. (FIG. 2)

Therefore, the crankcase 14 becomes compact in size, thus minimizing the outline shape of the engine.

In addition, the guide groove 32 has no radial projection but is formed only concentrically to the axis of the output shaft 25*a*, thus facilitating machining of the guide groove 32.

Furthermore, the employment of this arrangement of the two interlocking mechanisms 34*a* and 34*b* across the output shaft 25*a* according to the invention, permits the exhaust valve to be easily disposed adjacent to the intake valve 20 at right angles to the axial direction of the output shaft 25*a*, thus facilitating so-called "L-type" arrangement in which the intake valve 20 and the exhaust valve are disposed in juxtaposition adjacent to the cylinder 14.

When the cam faces 39*d* and 39*g* are designed to depress up against the periphery of the bottom faces of the flat tappets 40*a* and 40*b*, the sliding contact of the cam faces 39*d* and 39*g* will provide the flat tappets 40*a* and 40*b* with rotational movement to rotate the intake valve 20 and the exhaust valve, which makes it possible to run in the contact faces of both valves to the mating valve seats.

Additionally, since the rocking members 38 are so constructed as to rock about the journal 36, the inertia force about the journal 36 can be reduced to improve the tracking of the rocking members 38 at a high speed rotation of the engine.

The reduction of face pressure between the cam faces 39*d* and 39*g* and the flat tappets 40*a* and 40*b* brings about their longer life.

In addition, the cam faces 39*d* and 39*g* having the nearly same shape as the common cam faces are easily machined.

Means for lifting the intake and exhaust valves by rocking the rocking members can have many variations other than the above embodiment.

Figure 6:
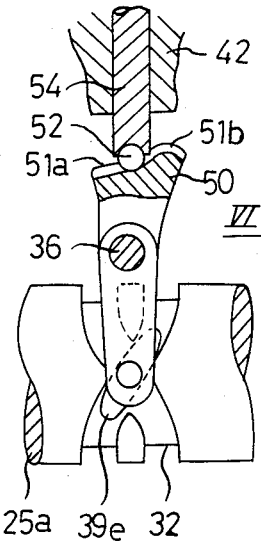
FIG. 6 is a fragmentary view taken in the direction of the arrow VI in FIG. 5.
Figure 5:
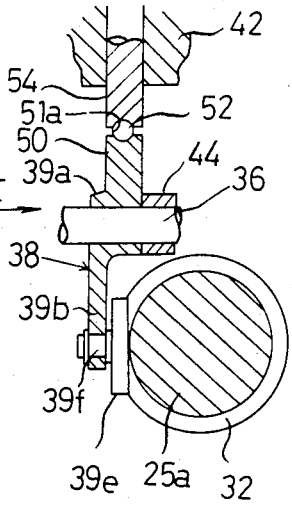
FIG. 5 is a vertical view of the major parts of a second embodiment according to the invention.

For example, as shown in a second embodiment illustrated in FIGS. 5 and 6, a sector-like cam 50 is integrally formed extending upwards from a boss 39*a* in a rocking member 38. A guide groove 51*a* of such a section as a nearly semi-circle is cut at the top surface of the cam 50, and provides a higher portion 51*b* as shown in FIG. 6, to lift the intake valve 20 to a given crankshaft angle.

A rotating ball 52 engaging in the guide groove 51*a* is rotatably recessed into the lower end of a rod 54, which vertically fits slidably into a supporting wall 42. The top end surface of the rod 54 comes in contact with the valve stem of the intake valve 20 to open the intake valve 20.

On the other hand, the exhaust valve mechanism is so constructed similarly to that of the intake valve 20 as mentioned above, as to open the exhaust valve.

From now, the operation of the above second embodiment is described. While an output shaft 25*a* makes two turns, a follower 39*e* in the rocking member 38 once rocks about a journal 36 while being guided along by the guide groove 32. Similarly, the cam 50 rocks about the journal 36. This rocking motion of the cam 50 leads the rotating ball 52 engaging in the guide groove 51*a* to rise and fall along the guide groove 51*a* while sliding thereon. The rising of the rotating ball 52 on the higher portion 51*b* results in lifting the rod 54, for example, to open the intake valve 20 to a given crankshaft angle.

The amount of lift of the rods 54 can be optionally adjusted by changing the height of the higher portion 51*b*. And, the change in the amount of lift of the rods 54 relative to the crankshaft angle, i.e. lift curve, can be arbitrarily changed by adjusting the shape of the guide groove 51*a*. According to this construction, the flat tappets can be eliminated because of the direct lifting of the rods.

Figure 7:
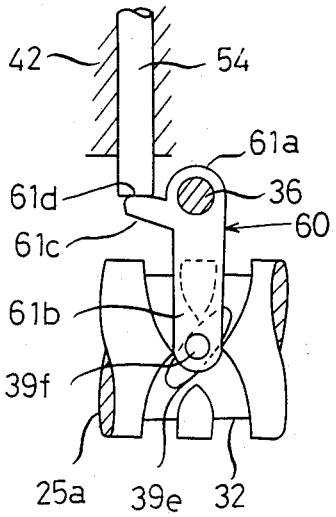
FIG. 7 is a front view of the major parts of a third embodiment according to the invention.

The following is the description of a third embodiment adapted for a valve gear referring to FIG. 7. In FIG. 7, the like reference numerals are provided for the like or corresponding parts as those in aforesaid embodiment in FIG. 5.

A rocking member 38 supported by a journal 36 is formed as a bell crank 60 which is a one-piece forging consisting of a boss 61*a*, an arm 61*b* and a pushing portion 61*c*. The arm 61*b* extends from the boss 61*a* down to the side of an output shaft 25*a*, and at the lower end thereof supports rotatably a follower 39*e* through a shaft 39*f*. The pushing portion 61*c* extends to the left in the figure from the side of the boss 61*a*, and a top surface 61*d* thereof is shaped into arc to receive the lower end surface of a rod 54.

The operation of the third embodiment is as follows. While the output shaft 25*a* makes two turns, the follower 39*e* in the rocking member 38 is guided along the guide groove 32, and the arm 61*b* rocks about the journal 36. The pushing portion 61*c* similarly rocks about the same journal 36, which results in the rod 54 rising only once to a given crankshaft angle to lift, for example, the intake valve 20.

The bell cranks 60 having a relatively simple shape and construction can be easily machined and fabricated in low cost.

And, the rods 54 can rise and fall smooth without being subjected to any thrust.

Figure 9:
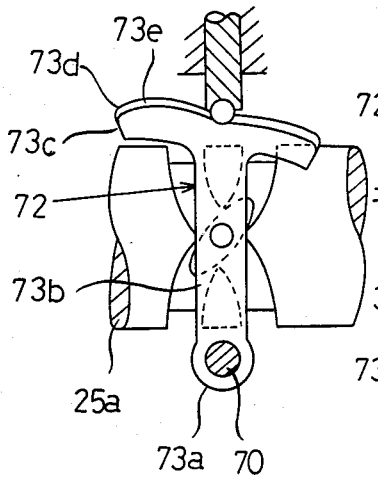
FIG. 9 is a fragmentary view taken in the direction of the arrow IX in FIG. 8.
Figure 8:
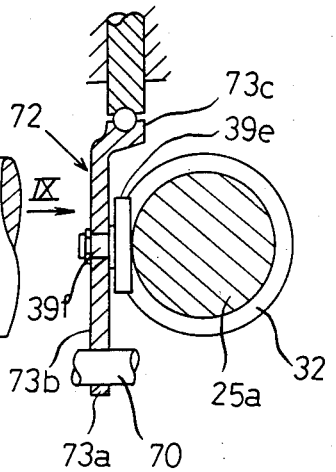
FIG. 8 is a vertical sectional view of the major parts of a fourth embodiment according to the invention.

The following is the description of a fourth embodiment referring to FIGS. 8 and 9. This is a modified embodiment of the second embodiment shown in FIGS. 5 and 6, so in FIG. 8, the like reference numerals are provided for the like or corresponding parts as those in FIG. 5.

A journal 70 provided under an output shaft 25*a* is disposed at right angles to the output shaft 25*a*. A rocking member 72 rotatably fits onto the journal 70.

The rocking member 72 is a one-piece forging consisting of a boss 73*a*, an arm 73*b* and a cam 73*c*. The arm 73*b* extends upwards from the boss 73*a*. A follower 39*e* is rotatably supported by a shaft 39*f* at the middle of the arm 73*b*. And, at the upper end thereof, the cam 73*c* is formed, on the top of which is cut a guide groove 73*d*. A rotating ball 52 is recessed into the guide groove 73*d* to lift a rod 54 by a higher portion 73*e* in the guide groove 73*d*.

According to the embodiment, the distance between the journal 70 and the rods 54 becomes longer than that shown in FIG. 5, thus permitting the guidegroove 73*d* to rock in larger circle.

Therefore, the guide groove 73*d* is allowed for a relatively large length, thus creating a smooth shape which results in easy machining.

Figure 11:
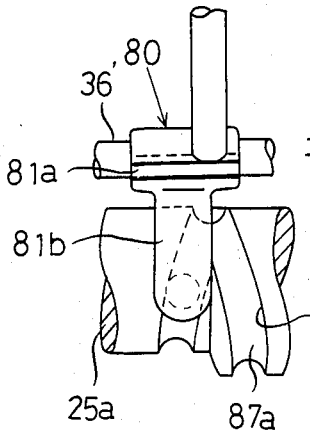
FIG. 11 is a fragmentary view taken in the direction of the arrow XI in FIG. 10.
Figure 10:
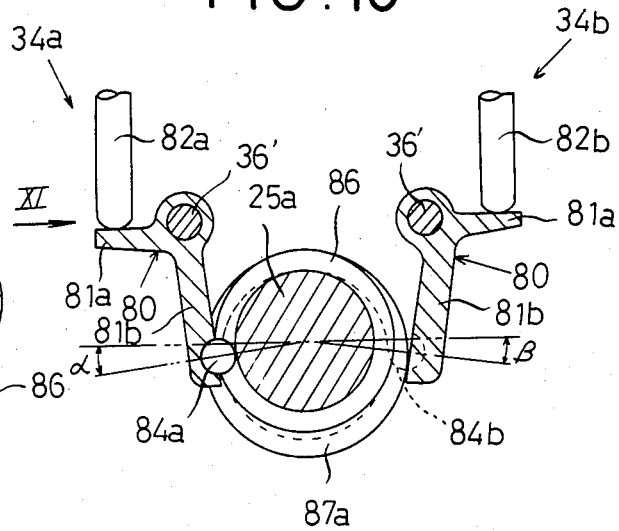
FIG. 10 is a sectional view of the major parts of a fifth embodiment according to the invention.

The following is the description of a fifth embodiment adapted for a valve gear referring to FIGS. 10 and 11. In FIGS. 10 and 11, the like reference numerals are provided for the like or corresponding parts as those in FIG. 1.

In this embodiment, interlocking mechanisms 34*a* and 34*b* are formed as bell cranks 80 rocking about journals 36' parallel to an output shaft 25*a*. The bell crank 80 has a side arm 81*a* and a vertical arm 81*b*, and for example, a rod 82*a* for the intake valve 20 depresses down against the side arm 81*a*. A ball 84*a* rotatably recessed into the lower side end of the vertical arm 81*b* is slidably in contact with a guide groove 86 formed at one location on the circumference of the output shaft 25*a*.

The guide groove 86 has a "cross" shape as X, folding around the output shaft, while returning back to a starting point in two turns, and, at one point therein, has a higher portion 87*a* formed so as to extend radially outwards of the output shaft 25*a*.

The ball 84*a* for the intake valve 20 is offset by angle $\alpha$, and the ball 84*b* for the exhaust valve by angle $\beta$, as shown in FIG. 10, to open respectively the intake valve 20 and the exhaust valve respective given crankshaft angles.

The operation of the fifth embodiment is as follows: According to the embodiment, while the output shaft 25*a* makes two turns, the both bell cranks 80 respectively rock only once to respective given crankshaft angles by the higher portion 87*a*, which results in the rods 82*a* and 82*b* rising and falling to lift respectively the intake valve 20 and the exhaust valve.

Figure 12:
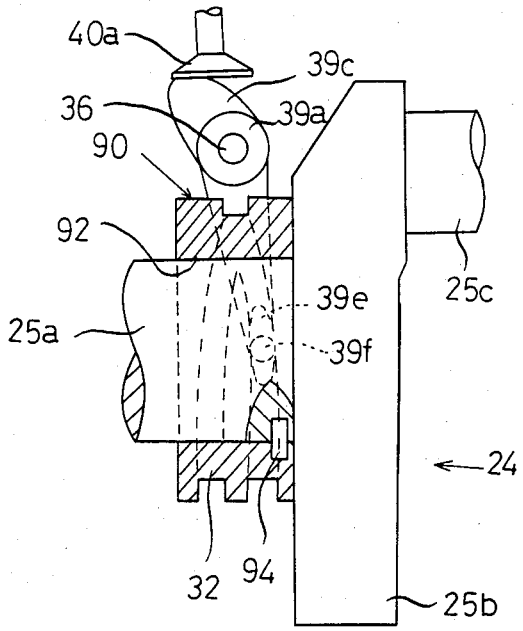
FIG. 12 is a vertical sectional view of the major parts of a sixth embodiment according to the invention.

The following is the description of a sixth embodiment according to the invention referring to FIG. 12. According to the embodiment, a guide groove 32 for a valve gear is not directly formed on the outer surface of an output shaft 21*a*, but, as shown in FIG. 12, formed on the outer surface of a collar 90 formed on a block other than the output shaft 25*a*, and fitted thereonto. Except for the above, the construction of the embodiment is similar to that of the first embodiment shown in FIG. 1 through FIG. 4, so the like reference numerals are provided for the like parts as those in the first embodiment.

An inner surface 92 of the collar 90 having a basically cylindrical shape is in close contact with the outer surface of the output shaft 25*a*, and the collar 90 is secured onto the output shaft 25*a* with set pins 94.

Because, in the valve gear of this embodiment, the guide groove 32 is formed on the collar 90 made separately from the output shaft 25*a* connected to a crankshaft 24, only the collar 90 is required to be machined precisely to form the guide groove 32 on the outer surface thereof, in the manufacture of the engine. When the guide groove 32 of a complex shape is machined, the collar 90 can be easily mounted on the machine in any position, or easiy handled by the operator, because the collar 90 is very small compared with the crankshaft 24.

When the guide groove 32 must be hardened for anit-wear since the followers 39*e* are slidably in contact therewith, only the collar 90 formed separately from the crankshaft 24 suffices to be hardened and heat treated. As the result, the guide groove 32 can be hardened for reducing the wear of the guide groove 32, while the conventional guide grooves formed integrally from the crankshaft 24 have had difficulties to harden.

Additionally, when the guide groove 32 gets worn due to a long period of use, only the separate collar 90 can be taken out of the crankshaft 24 to replace it with a new collar 90.

When the valve timing is changed, it can be adjusted only by changing the circumferential angle position of the collar 90 fixed with the set pins 94.

Figure 13:
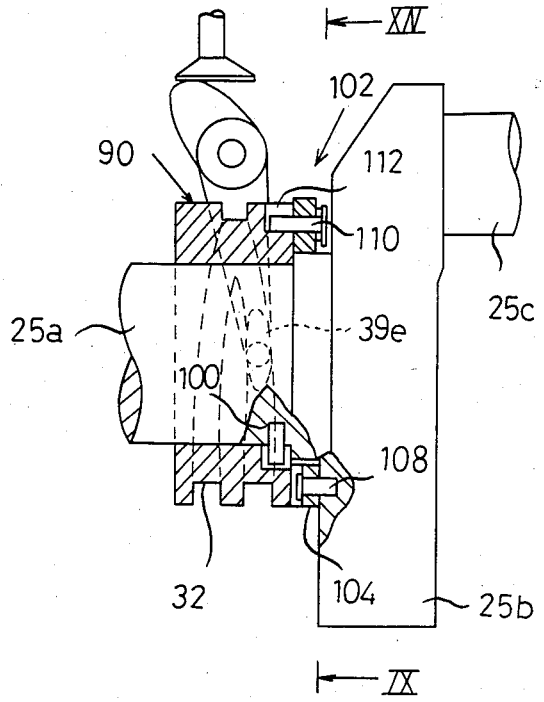
FIG. 13 is a vertical sectional view of the major parts of a seventh embodiment according to the invention.
Figure 15:
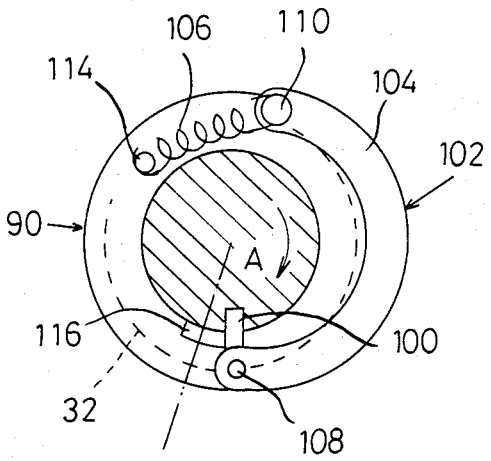
FIG. 15 is an illustration showing the action of the seventh embodiment along with FIG. 14.
Figure 14:
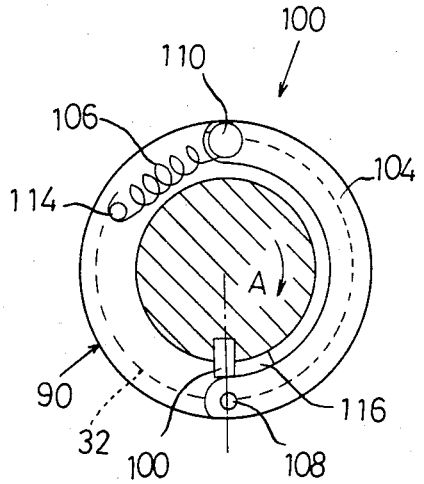
FIG. 14 is a segmentary view taken in the direction of the arrow XIV in FIG. 13.

The following is the description of a seventh embodiment referring to FIG. 13 through FIG. 15. According to the embodiment, the valve timing is made variable to meet the performance of the engine, by providing a guide groove 32 for a valve gear on a collar 90 formed separately from an output shaft 25*a*, so as to change the angle position to the output shaft 25*a*.

In FIG. 13 showing the major parts of the seventh embodiment, the like reference numerals are provided for the like or corresponding parts as those in aforesaid embodiment in FIG. 12.

The collar 90 is held on the output shaft 25*a* with set pins 100 so as to rotate circumferentially within a fixed range of angle as detailed later. A small space is provided for between the right end surface of the collar 90 and the left end surface of a crank web 25*b*, in the figure, and a centrifugal governor 102 (timing control mechanism) is provided therein for changing the valve timing.

As shown in FIG. 14, the centrifugal governor 102 consists of a governor weight 104, a coiled tension spring 106, a set pin 108, and an engaging pin 110. The governor weight 104 has such a shape as an arc extending over the nearly half of the circumference of the collar 90 and is set to a given mass. The lower end portion of the governor weight 104 is rotatably held with the set pin 108, which is secured on the crank web 25*b*. (FIG. 13)

On the other hand, the upper end portion of the governor weight 104 has the engaging pin 110 engaging with a cutout portion 112 (FIG. 13) in the collar 90, and is also engaged with the right end portion of the coiled tension spring 106. (FIG. 14) The left end portion of the coiled tension spring 106 is fixed to the left end surface of the collar 90 (FIG. 13) with a pin 114.

An arc-shaped groove 116 is formed on the inner surface of the left end of the collar 90, and the collar 90 is held on the circumference of the output shaft 25*a* rotatably within the arc-shaped groove 116 with aforesaid pin 100 engaging therewith.

The operation of the embodiment is as follows. While the engine is running, the rotation of the output shaft 25*a* in the direction of Arrow A produces a centrifugal force acting on the governor weight 104. At a low engine speed with a small centrifugal force, the governor weight 104 is pulled to the left in FIG. 14 forced by the coiled tension spring 106, and the collar 90 connecting with the engaging pin 110 at the cutout portion 112 comes to zero in advance angle with a portion of the guide groove 32 engaging with a follower 39*c* forcedly positioned to the utmost right end. Then, the valve timing is brought to the optimum for a low engine speed.

As the engine speed gathers up, the centrifugal force acting on the governor weight 104 increases to cause the upper end portion thereof to rotate about the set pin 108 to the right side against the force of the coiled tension spring 106. Which causes the collar 90 connecting with the engaging pin 110 in the cutout portion 112 to rotate in the direction of Arrow A. As the result, the portion of the guide groove 32 engaging with the follower 39*e* moves within the arc-shaped groove 116, thus increasing advance angle by this movement. Therefore, the valve timing falls on a new optimum for a high engine speed.

As mentioned above, according to the invention, the interlocking mechanisms driving the intake and exhaust valves are interlocked with the single guide groove provided on the output shaft connected to the crankshaft, functioning to open both the intake and exhaust valves, thus eliminating the need for providing two guide grooves for the intake and exhaust valves on the output shaft, so minimizing the length of the crankshaft.

As the result, the crankcase becomes compact and further the outline shape of the whole engine becomes small.

In addition, so-called "L-type" arrangement, wherein the intake and exhaust valves are disposed in juxtaposition to a side of the cylinder, can be easiy realized because both valves are easily juxtapositioned to each other.

The invention can also apply to the over-head type engine, not limited only to the side-valve type engine in FIG. 1.

It will be obvious to those skilled in the art that various changes may be made to the invention without departing from the spirit and scope thereof and therefore the invention is not limited by that which is shown in the drawings and described in the specifications but only as indicated in the appended claims.

What is claimed is:

1. A valve gear adapted for a four-cycle engine having a guide portion formed on the outer circumference of an output shaft connected to a crankshaft and of such a shape, folding around said output shaft as to return back to a starting point in two turns, and having interlocking means provided with a portion engaging with said guide portion and moved by the rotation of said crankshaft to open intake and exhaust valves, wherein the improvement resides in that:

said guide portion, only one in number, is provided on said one output shaft; and said interlocking means, two in number, respectively driving said intake and exhaust valves, are so disposed basically opposite to each other across said output shaft as to engage with said single guide portion, wherein said guide portion is so formed that the guide position of said interlocking means axially reciprocates once, keeping the same radial distance from the rotation axis of said crankshaft, in two turns thereof; said interlocking means are rotatably supported about a journal intersecting at right angles with said output shaft, and one point on each of said interlocking means is provided with a rocking member engaging with said guide potion; and said rocking member is provided with means to lift said valve by the rocking motion.

2. A valve gear as claimed in claim 1, wherein said means for lifting said valves by the rocking motion of said rocking members are cam faces disposed outwards radially from said journal, and in sliding contact with flat tappets interlocking with valve stems.

3. A valve gear as claimed in claim 1, wherein said means for lifting said valves by the rocking motion of said rocking member are guide grooves disposed outwards radially from said journal, and engages with end portions of said valve stems or rods interlocking therewith.

4. A valve gear as claimed in claim 1, wherein said rocking members are bell cranks, and said means for lifting said valves by the rocking motion of said rocking members are arms engaging with the end portions of said valve stems or rods interlocking therewith.

5. A valve gear as claimed in claim 1, wherein said guide portion is fabricated from a block other than said output shaft.

6. A valve gear as claimed in claim 5, wherein said guide portion is formed on the outer surface of an essentially cylindrical collar removable from said output shaft.

7. A valve gear adapted for a four-cycle engine having a guide portion formed on the outer circumference of an output shaft connected to a crankshaft and of such a shape, folding around said output shaft as to return back to a starting point in two turns, and having interlocking means provided with a portion engaging with said guide portion and moved by the rotation of said crankshaft to open intake and exhaust valves, wherein the improvement resides in that:

said guide portion, only one in number, is provided on said one output shaft; and said interlocking means, two in number, respectively driving said intake and exhaust valves, are so disposed basically opposite to each other across said output shaft as to engage with said single guide portion, wherein said guide portion is a cam having one higher portion extending outwards in the radial direction of said output shaft; and said interlocking means comprise bell cranks each being supported rotatably about and slidably along a journal parallel to said output shaft.

8. A valve gear adapted for a four-cycle engine having a guide portion formed on the outer surface of an output shaft connected to a crankshaft, and of such a shape folding around said output shaft as to return back to a starting point in two turns, and having interlocking means, each of which is provided with a portion engaging with said guide portion and being moved by the rotation of said crankshaft to open intake and exhaust valves, wherein:

said guide portion, only one in number, is provided on an outer surface of of substantially cylindrical collar supported by said output shaft so as to be able to adjust the rotation angle position relative to said output shaft;

said two interlocking means respectively driving said intake and exhaust valves are disposed essentially opposite to each other across said output shaft as to engage with said single guide portion; and the valve gear comprises timing control means for adjusting the rotation angle position of said guide portion relative to said output shaft according to the performance of the engine; and said valve timing being adjustable.

9. A valve gear as claimed in claim 8, wherein said timing control means is a centrifugal governor provided with a governor weight to rotate said guide portion about said output shaft by centrifugal force acting on said weight, with one end thereof being supported by said output shaft and the other end by said collar through a spring.

* * * * *